United States Patent [19]

Shimazu et al.

[11] Patent Number: 4,960,663

[45] Date of Patent: Oct. 2, 1990

[54] PERSISTENT PHOTOCONDUCTIVE COATING COMPOSITION

[75] Inventors: Ken-ichi Shimazu, Briarcliff Manor, N.Y.; Jayanti Patel, Fairlawn, N.J.; Jill Tolfree, Yonkers, N.Y.

[73] Assignee: Polychrome Corporation, Yonkers, N.Y.

[21] Appl. No.: 322,650

[22] Filed: Feb. 27, 1989

[51] Int. Cl.[5] ..... G03G 5/09

[52] U.S. Cl. ..... 430/70; 430/75; 430/83

[58] Field of Search ..... 430/83, 56, 75, 70

[56] References Cited

U.S. PATENT DOCUMENTS 4,033,769 7/1977 Williams et al. ..... 430/80

4,444,860 4/1984 Yasujima et al. ..... 430/51

*Primary Examiner*—John L. Goodrow

*Attorney, Agent, or Firm*—Jack Matalon

[57] ABSTRACT

A persistent photoconductive coating composition contains a persistent photoconductor, photoinitiator, an acetate or phenolic hydroxyl containing resin and ketone dispersed in an inert coherent matrix.

24 Claims, No Drawings

PERSISTENT PHOTOCONDUCTIVE COATING COMPOSITION

BACKGROUND OF THE INVENTION

Xerography is a well-known process for the formation and development of images on the imaging surfaces of photoconductive materials by electrostatic means. The process involves forming a latent electrostatic image on the imaging surface of an imaging member by first uniformly electrostatically charging the imaging surface and then exposing the charged surface selectively to light The electrostatic charge is selectively dissipated in irradiated areas leaving a member having selected areas of charged surface. Thereafter, the image is rendered visible by development with a finely divided colored electroscopic material known in the art as a "toner" which is principally attracted to the charges areas of the surface.

A number of materials, hereinafter referred to as "persistent photoconductors", have been noted which are characterized by exhibiting a substantial lag in returning to their original state of dark conductivity after illumination. This permits the imaging sequence to be reversed from that of xerography, namely an uncharged imaging layer is initially selectively irradiated to render areas persistently conductive in an imagewise fashion and thereafter a charge is imposed on the entire surface, but is only selectively processed by the persistently conductive areas. Persistent photoconductors and their use are described in a number of references, including i.e., *Persistent Conductivity, Electrophotography,* R. M. Schoffert ed. (Foral Press 1965) pp. 70–77; Nisho and Inoue, *Photo-Induced Memory Effect of Organic Photoconductor,* Photographic Science & Engineering 22:194 (1978), 22:35 (1981) and 26:24 (1982); and Hanna and Inoue, *The Design of An Organic Photoreceptor With A Charge-Acceptance Memory,* Photographic Science & Engineering 25:209 (1981), 26:69 (1982), and 27:51 (1983) and also in a number of U.S. patents including U.S. Pat. Nos. 3,113,022, 3,519,966 and 3,879,201, the disclosure of all of which is hereby incorporated by reference.

A problem which has characterized persistent photoconductivity compositions heretofore is that the image quality is both generally insufficient and the quality has a tendency to degenerate as the speed of exposure is increased. Also, there is a low toner image density. A number of additives have been described which improve the persistent conductivity characteristics, that is, permit extremely short exposure times to produce relatively long persistent conductivity, but such additives have not been found to improve image quality. In the experimentation which led to the present invention, it was also found that some additives improved image quality but they caused a decrease in the persistent conductivity characteristics of the persistent photoconductive composition.

It is accordingly the object of this invention to provide new persistent photoconductive compositions which not only require only extremely short exposure times to achieve relatively high persistent conductivity, but also exhibit improved image quality. This and other objects of the invention will become apparent to those of ordinary skill in this art from the following detailed description.

SUMMARY OF THE INVENTION

This invention relates to an improved persistent conductivity composition, plate and the use thereof. More particularly, the invention relates to an improved composition which contains a persistent photoconductor, a photoinitiator, and a phenolic hydroxyl or acetate containing resin which is dispersed in an inert coherent matrix, a plate comprising such composition on a conductive substrate, and the use of the same for forming an image.

DESCRIPTION OF THE INVENTION

In accordance with the present invention, a conventional persistent photoconductive composition which comprises a persistent photoconductor dispersed in an inert coherent matrix is improved by incorporating therein a photoinitiator and a condensation product of a polyhydroxylated aromatic hydrocarbon and a ketone. As will be shown below, incorporation of only the photoinitiator into the basic composition improves the persistent photoconductivity characteristics of the composition, but does not improve image quality. Incorporation of the polyhydroxylated condensation product alone improves image quality, but concomitantly causes the persistent conductivity characteristics to substantially degenerate. Surprisingly, when both the condensation product and the photoinitiator are added into the persistent photoconductive composition, both the persistent photoconductivity characteristics and image quality improve. The %PEM (100 x (initial voltage —residual voltage/initial voltage) is an acceptable value of at least 70%.

The basic persistent photoconductivity composition is composed of organic photoconductive electron donor materials, including what has been termed a "small molecule" photoconductor, dispersed in an inert coherent matrix. These so-called "small molecule" photoconductive materials include the following oxadiazoles; e.g., 2,5-bis[4'-diethylaminophenyl]-1,3,4-oxadiazole, 2,5-bis[4'-n-propylamino]-2-chlorophenyl-(1')]-1,3,4-oxadiazole, 2,5-bis[4'-N-ethyl-N-n-propylaminophenyl-(1')]-1,3,4-oxadiazole, 2,5-bis[4'-diethyl-aminophenyl]-1,3,4-oxadiazole; triazoles, e.g., 1-methyl-2,5-bis-[4'-dimethylaminophenyl]-1,3,4-triazole; imidazoles, e.g., 2-(4'-dimethylaminophenyl)-6-methoxybenzimidazole; oxazoles, e.g., 2-(4'-chlorophenyl)phenanthreno-(9'–10':4,5)-oxazole; thiazoles, e.g., 2-(4'-dimethylaminophenyl)-benzathiazole; thiophenes, e.g., 2,3,5-triphenylthiophene; triazines, e.g., 3-(4'-aminophenyl)-5,6-dipyridyl-(2')-1,2,4-triazin e, 3-(4'-dimethylamino-phenyl)-5,6-di(4'-phenoxyphenyl)-1,2,4-triazine; hydrazones, e.g., 4-dimethylaminobenzaldehyde isonicotinic acid hydrazone; styryl compounds, e.g., 2-(4'-dimethylaminostyryl)-6-methyl-4-pyridone, 2-(4'-dimethylaminostyryl)-5-(or 6)-aminobenzimidazole, bis(4-dimethylaminostyryl) ketone; azomethines, e.g., 4-dimethylaminobenzylidene-$\beta$-naphthylamine; acylhydrazones, e.g., 4-dimethylaminobenzylidenebenzhydrazine, 4-dimethylaminobenzylidene-4-hydroxybenzoic hydrazide, 4-dimethylaminobenzylidene-2-aminobenzoic hydrazide, 4-dimethylaminobenzylidene-4-methoxybenzoic hydrazide, 4-dimethylaminobenzylidene-iso-nicotinic hydrazide, 4-dimethylaminobenzylidene-2-methylbenzoic hydrazide; pyrazolines, e.g., 1,3,5-triphenylpyrazoline, 1,3-diphenyl-5-[4'-methoxy-phenyl]pyrazoline, 1,3-diphenyl-5-[4'-dimethylaminophenyl]pyrazoline; 1,5-diphenyl-3-styrylpyrazoline; 1-phenyl-3-[4'-dimethylaminostyryl]-5-[4'-dimethylamino phenyl]-pyrazoline; imidazolones, e.g., 4-[4'-dimethylaminophenyl]-5-phenylimidazolone, 4-furfuryl-5-phenylimidazolone; imidazolethiones, e.g., 4-[4'-dimethylaminophenyl]-5-phenylimidazolethione, 3,4,5-tetraphenylimidazolethione, 1,3,5-triphenyl-4-[4'-dimethylaminophenyl-]imidazolethione, 1,3,4-triphenyl-5-furfurylimidazolethione; benzimidazoles, e.g., 2-4'-dimethylaminophenyl]-benzimidazole, 1-methyl-2-[4'-dimethylaminophenyl]-benzimidazole, 1-phenyl-2-[4'-dimethylaminophenyl]-benzimidazole; benzoxazoles, e g , 2-[4'-dimethylaminophenyl]-benzoxazole; and benzothiazoles, e.g., 2-[4'-dimethylaminophenyl]-benzothiazole.

Materials which can be effectively used to provide the inert cohesive matrix for dispersion of the above "small molecule" photoconductors are polymers having fairly high dielectric strength and which are good electrically insulating film forming vehicles. Typical of such inert polymer matrices are: styrene butadiene copolymers; silicone resins, styrene-alkyd resins; soya-alkyd resins; polyvinyl chloride; styrenemaleic anhydride; polyvinylidene chloride; vinylidene chloride-acrylonitrile copolymers; polyvinyl acetate; vinyl acetate-vinyl chloride copolymers; polyvinyl acetals, such as polyvinyl formal; polyacrylic and methacrylic esters, such as polymethyl methacrylate, poly-n-butyl methacrylate, polyisobutyl methacrylate; polystyrene; nitrated polystyrene; polymethylstyrene; isobutylene polymers; polyesters, such as polyethylenealkaryloxyalkylene terephthalate; phenol formaldehyde resins; ketone resins; polyamides; and polycarbonates. Methods of making resins of this type have been described in the prior art, for example, styrene alkyd resins can be prepared according to the method described in U.S. Pat. Nos. 2,361,019 and 2,258,423.

The phenolic hydroxyl or acetate containing resin used in the present invention includes commercially available materials such as cellulose acetate phthalate, polyvinyl acetate, phenol-formaldehyde resins or can be formed by reacting a polyhydroxylated aromatic hydrocarbon with an aldehyde ketone, preferably in the presence of a catalyst. The formation of this product generally parallels the formation of bisphenol-A from acetone and phenol. The polyhydroxylated aromatic hydrocarbon may be in a single-ring compound based on benzene, i.e. have a phenyl nucleus, or may be a multiple fused-ring nucleus such as naphthyl Examples include catechol, resorcinol, phlonoglucinol and pyrogallol among other aromatics. The aldehyde ketones preferably contain one to about eight carbon atoms such as formaldehyde, acetone, methyl ethyl ketone, pentanone, hexanone, methyl isobutyl ketone and the like. The preferred condensation product is the polyhydroxyphenyl formed from the reaction of acetone and pyrogallol at about room temperature in the presence of a catalyst, for example, phosphorus oxychloride. This product can be dissolved in ketones, alcohols and the like, and has a molecular weight of about 1,000 to 1,800.

The photoinitiators used in the composition of the present invention can be any photoinitiator which has been used heretofore for the preparation of photosensitive compositions Such materials include such diverse materials as benzophenone, anthraquinone, penanthrenequinone, Micheler's ketone, dihydroxybenzophenone, chlorobenzophenone, tribromoimidazole, trichlorpyrimidine and the like. The preferred photoinitiators are a biimidazolidine, triazine or ketone type initiators, preferably a per(halophenylated) biimidazolidine 2,6-di(trichloromethyl)-4-substituted-1,3,5 triazines, or a benzophenone. The most preferred photoinitiators are N-[1-(2',3',5-tri-o-chlorophenyl)imidazolidinyl]-2,4,5-tri-o-chlorophenyl-imidazolidine, 4-(p-methoxyphenyl)-2,6-di(trichloromethyl)-1,3,5-triazine, 4-(2-naphthyloxy)-2,6-di(trichloromethyl)-1,3,5-triazine, 4-phenylethynyl-2,6-di(trichloromethyl)-1,3,5triazine, and benzophenonetetracarboxyl acid dianhydride.

The coating composition of the present invention uses a persistent photoconductivity effective amount of the persistent photoconductor, preferably about 10 to 40 percent based on the weight of the total composition; about 0.5 to 8 percent of the photoinitiator and preferably about 1 to 4 percent; and about 0.5 to 5 weight percent of the phenolic hydroxyl or acetate resin, preferably about 1 to 3.5 percent. Any one or more of each of the photoconductors, initiators, resins or matrix can be used as a mixture of materials if so desired.

The persistent photoconductive coating compositions of the present invention are prepared by dispersing the constituents in an appropriate dispersion medium and applying the dispersion to a suitable substrate which is preferably self-supporting and conductive to form a film thereon. The medium, which can be for instance, benzene, toluene, acetone, butanone, chlorinated hydrocarbons such as methylene chloride, ethylene ethers such as tetrahydrofuran, or a mixture thereof, is therefore evaporated. Any standard coating technique can be used and film thickness can be controlled either by adjustment of the viscosity of the dispersion or by mechanical means or a combination of both The films thus produced form a substantially uniform, continuous and adhering coating on the substrate and ordinarily have an average film thickness of about 1 to 50 microns, preferably about 3 to 5 microns. Examples of suitable substrates include conductive paper, metals such as copper, aluminum, zinc, iron, tin and lead, polyethyleneteraphthalate having a thin over-coating of aluminum and copper and NESA glass.

In order to further describe the present invention, various representative examples are set forth below. Throughout these examples, as well as throughout the balance of this specification and claims, all temperatures are in degrees Centigrade and all parts and percentages are by weight unless otherwise specified.

EXAMPLE 1

This example describes the preparation of a persistent photoconductive coating composition and its use in accordance with the prior art.

44.4 parts of 2,5-bis[4'-diethylaminophenyl]-1,3,4-oxadiazole and 55.6 parts of a styrene maleic anhydride resin (Sunscript 54° by Monsanto Chemical; inert matrix) were dissolved in a 1:1 mixture of methyl Cellosolve and methyl ethyl ketone which was stirred for about 30 minutes and then coated on an aluminum substrate. The mixture was allowed to dry until the mixed solvent constituted less than 2 percent of the coating. The resulting plate, composed of the conductive aluminum carrying a film of about 5 microns in thickness, was exposed to a low power UV light at 1.5 mj/cm exposure and then charged with a high voltage corona. An oppositely charged toner was applied to the plate and fused in the image areas followed by washing the non-toned areas from the plate. The persistent photoconductivity characteristics of the coating was rated as good, but the quality of the image formed was rated as bad.

EXAMPLE 2

Example 1 was repeated except that 2.78 parts of the resin matrix was replaced with either N-[1-(2',3'5-tri-o-chlorophenyl)imidazolidinyl]-2,4,5-tri -o-chlorophenyl-imidazolidine of pyrogallol and acetone. The latter was prepared by dissolving 50 grams of pyrogallol in 350 grams of acetone to which was added 5 grams of phosphorus oxychloride as a condensation catalyst and after allowing the solution to stand overnight at room temperature, the solution was added dropwise into water with stirring to form a tarry resin. The resin was redissolved in acetone and reprecipitated in water. The precipitate solids were recovered by filtration and dried and found to have a melting point of 200–215° C.

The addition of the condensation product caused the image quality to become good, but the persistent photoconductivity characteristics of the composition became bad. Use of the photoinitiator alone, on the other hand, increased the persistent photoconductivity characteristics of the composition but had no effect on the image quality.

For comparative purposes, a third composition was prepared in which 2.78 parts of the resin matrix was replaced with maleic acid anhydride. This system behaved similarly to the basic formulation incorporating the photoinitiator, that is, the persistent conductivity characteristics improved but no effect was seen on the quality of the image.

EXAMPLE 3

Example 1 was repeated except that 2.78 parts of the resin matrix was replaced with succinic acid anhydride and another 2.78 parts of the resin matrix was replaced with the condensation product described in Example 2.

As shown in Example 2, when the acid anhydride was added to the basic formulation, the persistent conductivity characteristics improved without affecting the image quality. When the condensation product was now added to the acid anhydride containing formulation, the image quality became very good but the persistent photoconductivity characteristics degenerated to the point where they were inferior to the basic formulation shown in Example 1, i.e. without either the acid anhydride or condensation product.

EXAMPLE 4

Example 3 was repeated substituting N-[1-(2',3',5-tri-o-chlorophenyl)imidazolidinyl]-2,4,5-tri-o-chlorophenyl-imidazolidine for the acid anhydride and the amount was 2.1% (based on solids).

In contrast to the results achieved in Example 3, the basic formulation containing the photoinitiator and the condensation product showed persistent photoconductivity characteristics which were very good coupled with an image quality which was also very good. The %PEM was 85.2%.

EXAMPLES 5–8

Example 4 was repeated with equivalent results replacing the photoinitiator with the following photoinitiators:

| Example No. | Photoinitiator | % PEM |
|---|---|---|
| 5 | 4-(p-hydroxyphenyl)-2,6,-di(trichloromethyl)-1,3,5-triazine | 74.2 |
| 6 | 4-(naphthyloxy)-2,6,-di(trichloromethyl)-1,3,5-triazine | 71.4 |
| 7 | 4-(phenylethynyl)-2,6,-di(trichloromethyl)-1,3,5-triazine | 78.6 |
| 8 | benzophenonetetracarboxy acid dianhydride | 71.6 |

EXAMPLE 9

Example 4 was repeated except that the condensation product was a resorcinol-acetone resin which had been prepared in the presence of concentrated hydrochloric acid as a catalyst. The %PEM was greater than 90% and the image quality was comparable to that achieved in Example 4.

EXAMPLES 10–12

Example 3 was repeated substituting either a commercially available phenol formaldehyde resin, a commercially available cellulose acetate phthalate or a commercially available polyvinyl acetate. In each case, the %PEM was greater than 90%.

EXAMPLES 15–19

The image density (net of background) for Examples 4 and 9–12 was determined and is set forth in the following table in which the image density for the same composition but without the phenolic hydroxyl or acetate containing resin is also set forth for comparison.

| Resins | Net Image Density |
|---|---|
| None | 0.78 |
| Pyrogallol-acetone condensation product | 1.46 |
| Resorcinol-acetone condensation product | 1.62 |
| Cellulose acetate phthalate | 0.97 |
| Polyvinyl acetate | 1.45 |
| Phenol formaldehyde resin | 0.96 |

Various changes and modifications can be made in the products and processes of the present invention without departing from the spirit and scope thereof. The various embodiments which were disclosed herein were for the purpose of further illustrating the invention, but were not intended to limit it.

What is claimed is:

1. A persistent photoconductive coating composition comprising a persistent photoconductive effective amount of a persistent photoconductor, photoinitiator and an acetate or phenolic hydroxyl containing resin dispersed in an inert, coherent matrix.

2. A persistent photoconductive coating composition according to claim 1, in which the persistent photoconductor is selected from the group consisting of oxadiazole, triazole, oxazole, thiophene, triazine, hydrazone, styryl compound, azomethine, acylhydrazone, pyrazoline, imidazolone, imidazolethione, benzimidazole, benzoxazole and benzothiazole.

3. A persistent photoconductive coating composition according to claim 2, in which the photoinitiator is a biimidazoline, triazine or ketone type photoinitiator.

4. A persistent photoconductive coating composition according to claim 3, in which the persistent photoconductor is an oxadiazole.

5. A persistent photoconductive coating composition according to claim 4, in which the photoinitiator is a perhalophenylated biimidazolidine, 2,6-di (trichloromethyl)-4-substituted-1,3,5-triazine, acetophenone or benzophenone.

6. A persistent photoconductive coating composition according to claim 5, in which the photoinitiator is selected from the group consisting of N-[1-(2',3',5-tri-o-chlorophenyl)imidazolidinyl]-2,4,5-tri-o -chlorophenylimidazolidine, 4-(p-hydroxyphenyl)-2,6-di(trichloromethyl)-1,3,5-triazine, 4-(naphthyloxy)-2,6-di(trichloromethyl)-1,3,5-triazine, 4-(phenyl-ethynyl)-2,6-di(trichloromethyl)-1,3,5-triazine, and benzophenonetetracarboxy acid dianhydride.

7. A persistent photoconductive coating composition according to claim 6 in which the resin is a cellulose acetate phthalate, polyvinylacetate or a condensation product of a polyhydroxylated aromatic compound and an aldehyde or ketone.

8. A persistent photoconductive coating composition according to claim 7, in which the condensation product is the reaction product of acetone and pyrogallol and in which the inert matrix is an electrically insulating film forming resin.

9. A persistent photoconductive coating composition according to claim 8, in which the persistent photoconductor is 2,5-bis[4'-diethylaminophenyl]-1,3,4oxadiazole.

10. A persistent photoconductivity plate comprising a conductive substrate carrying a film of the persistent photoconductive coating composition of claim 1 thereon.

11. A persistent photoconductivity plate comprising a conductive substrate carrying a film of the persistent photoconductive coating composition of claim 4 thereon.

12. A persistent photoconductivity plate comprising a conductive substrate carrying a film of the persistent photoconductive coating composition of claim 6 thereon.

13. A persistent photoconductivity plate comprising a conductive substrate carrying a film of the persistent photoconductive coating composition of claim 8 thereon.

14. A persistent photoconductivity plate comprising a conductive substrate carrying a film of the persistent photoconductive coating composition of claim 9 thereon.

15. An electrically charged persistent photoconductive plate of claim 10, in which the charge is present at preselected portions of the film.

16. An electrically charged persistent photoconductive plate of claim 11, in which the charge is present at preselected portions of the film.

17. An electrically charged persistent photoconductive plate of claim 12, in which the charge is present at preselected portions of the film.

18. An electrically charged persistent photoconductive plate of claim 13, in which the charge is present at preselected portions of the film.

19. An electrically charged persistent photoconductive plate of claim 14, in which the charge is present at preselected portions of the film.

20. In a method of forming an image by charging a persistent photoconductive plate comprising a conductive substrate carrying a persistent photoconductive composition thereon, irradiating the charged plate and applying toner to the exposed charged plate, the improvement which comprises employing the persistent photoconductive coating composition of claim 1 as said persistent photoconductive composition.

21. In a method of forming an image by charging a persistent photoconductive plate comprising a conductive substrate carrying a persistent photoconductive composition thereon, irradiating the charged plate and applying toner to the exposed charged plate, the improvement which comprises employing the persistent photoconductive coating composition of claim 4 as said persistent photoconductive composition.

22. In a method of forming an image by charging a persistent photoconductive plate comprising a conductive substrate carrying a persistent photoconductive composition thereon, irradiating the charged plate and applying toner to the exposed charged plate, the improvement which comprises employing the persistent photoconductive coating composition of claim 6 as said persistent photoconductive composition.

23. In a method of forming an image by charging a persistent photoconductive plate comprising a conductive substrate carrying a persistent photoconductive composition thereon, irradiating the charged plate and applying toner to the exposed charged plate, the improvement which comprises employing the persistent photoconductive coating composition of claim 8 as said persistent photoconductive composition.

24. In a method of forming an image by charging a persistent photoconductive plate comprising a conductive substrate carrying a persistent photoconductive composition thereon, irradiating the charged plate and applying toner to the exposed charged plate, the improvement which comprises employing the persistent photoconductive coating composition of claim 1 as said persistent photoconductive composition.

* * * * *